United States Patent [19]

Van Koert

[11] Patent Number: 4,899,885

[45] Date of Patent: Feb. 13, 1990

[54] PLASTIC CONTAINER WITH STACKING ATTACHMENT PIECE

[75] Inventor: Cornelis G. Van Koert, Oosterhout, Netherlands

[73] Assignee: Wiva Verpakkingen B.V., Netherlands

[21] Appl. No.: 221,512

[22] PCT Filed: Nov. 6, 1987

[86] PCT No.: PCT/NL87/00030

§ 371 Date: Jun. 23, 1988

§ 102(e) Date: Jun. 23, 1988

[87] PCT Pub. No.: WO88/03504

PCT Pub. Date: May 19, 1988

[30] Foreign Application Priority Data

Nov. 6, 1986 [NL] Netherlands ..... 8602812

[51] Int. Cl.[4] ..... B65D 21/00; B65D 23/00

[52] U.S. Cl. ..... 206/512; 215/100 R; 215/100 A; 220/23.83

[58] Field of Search ..... 206/512, 502; 220/23.6, 220/23.83, 23.86; 215/6, 10, 100 R, 100 A

[56] References Cited

U.S. PATENT DOCUMENTS

| | | | |
|---|---|---|---|
| 2,563,141 | 8/1951 | Vazzano | 215/6 |
| 3,563,409 | 2/1971 | Gray | 206/512 |
| 3,744,656 | 7/1973 | Schiemann | 215/100 A |
| 3,746,200 | 7/1973 | Flider | 215/10 |
| 3,773,249 | 11/1973 | Hidding | 215/100 A |
| 4,331,239 | 5/1982 | Ortal | 215/6 |
| 4,541,529 | 9/1985 | Hestehave et al. | 215/10 |
| 4,708,253 | 11/1987 | Mednis | 220/23.6 |
| 4,785,931 | 11/1988 | Weir et al. | 215/6 |

FOREIGN PATENT DOCUMENTS

| | | | |
|---|---|---|---|
| 3621833 | 1/1988 | Fed. Rep. of Germany | 220/23.83 |

*Primary Examiner*—Stephen Marcus
*Assistant Examiner*—Stephen Castellano
*Attorney, Agent, or Firm*—Watson, Cole, Grindle & Watson

[57] ABSTRACT

A stackable plastic container includes a hollow body formed of a base, upstanding side walls connected to the base and a top wall with a filling and/or pouring neck, the peripheral edge of the top wall connecting onto the side walls at a shorter distance from the base than the filling and/or pouring neck, and a stacking attachment piece which has a lower bounding plane fitting onto the top wall as well as an upper surface complementary to the base of the hollow body and lying above the filling-/pouring neck. Because the filling/pouring neck lies higher than the peripheral edge of the top wall, 100% emptying of the container is always gauranteed. The attachment piece enables stacking because the space between the top wall of the hollow body and the base of a hollow body of another container above it is occupied by the attachment piece.

12 Claims, 2 Drawing Sheets

PLASTIC CONTAINER WITH STACKING ATTACHMENT PIECE

BACKGROUND OF THE INVENTION

The invention relates to a container of plastic material provided with a base, side walls connected thereto and a top wall with a filling and/or pouring opening.

Such a container is often used for liquids or pourable substances, whereby the problem occurs that the container cannot be entirely emptied. This comes about because the container is formed such that it is stackable. For that purpose the pouring opening may not protrude above the top wall, so that when emptying takes place substance remains behind in the container.

The invention has for its object to form the container such that this problem is obviated, whereby the container nevertheless remains stackable.

SUMMARY OF THE INVENTION

The container according to the invention is distinguished in that the peripheral edge of the top wall connected onto the side wall lies at a shorter distance from the base than the filling and/or pouring opening, and whereby a stacking attachment piece is utilized which has a lower bounding plane fitting onto the top wall as well as an upper surface complementary to the base of the container.

Since the filling and/or discharge opening lies higher than the peripheral edge of the top wall, 100% emptying of the container is always guaranteed. The attachment piece nevertheless offers the possibility of stacking, because the space between the top wall and the base of respective containers stacked on one another is filled by the attachment piece.

If the container is formed with a filling and/or pouring stub which protrudes above the top wall, the height of the attachment piece will in accordance with the invention then be equal to at least the height of the stub. The attachment piece hereby also achieves a protecting function because, in the case the container falls over, the stub is safeguarded from lateral shocks by the attachment piece.

In one embodiment the attachment piece is formed with open portions for accomodating handles arranged on the top wall of the container. The manageability of the container is thereby not only facilitated but also made safer. Fastening of the attachment piece to the top wall of the container can be performed in particularly efficient manner by providing the openings in the attachment piece with a base plate having through-running holes through each of which is fed a projection, to which can be attached a handle. As a result of this fastening the attachment piece is locked onto the container.

Finally, the container may be provided with a aerating system to prevent "gurgling" during rapid emptying.

Above mentioned and other characteristics will be elucidated with reference to the figure description following hereinafter of an embodiment.

DETAILED DESCRIPTION OF THE PREFERRED EMBODIMENTS

Figure 1:
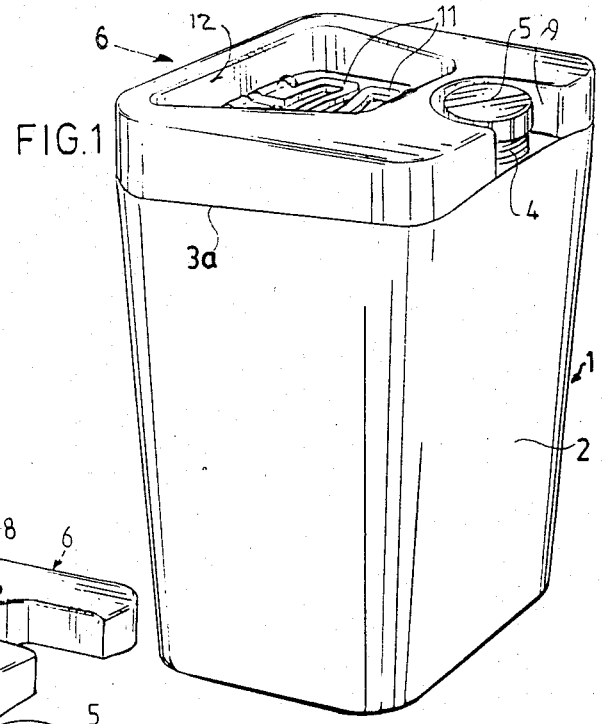
FIG. 1 shows a perspective top view of a container according to the invention.

The container shown in the figures is preferably made from synthetic resin material like HMWHDPE, LLPDE, LDPE, PP, EVA, PBT chlorinated PE, UHDPE, PET, PPO, PC or mixtures and copolymers, c.g. multilayers based on these materials. The material can be provided with additives like an EV stabiliser, anti-static agent, impact modifier and compatibilisors. The container consists of a hollow body 1 that includes a base (not visible) having side walls 2 connecting thereto which connect at the top to the peripheral edge 3*a* of a top wall 3. This is provided at a randomly suitable position with a filling and/or pouring stub 4 which can be formed on the outside with a screwthread for placing a screw cap 5. This is a per se known closure for a container. The pouring stub can be formed with an aerating hole 4' having connected to it an aerating channel (not shown) along the inner side of the top wall 3.

In accordance with a feature of the invention the top wall 3 is formed such that the filling and/or pouring stub lies higher than the peripheral edge 3*a*, so that wall parts 3' and 3'' run upward from peripheral edge 3*a* in the direction of the stub 4. Wall part 3'' can take a flat form for placing of the stub 4. With such a design the hollow body 1 can be 100% emptied by turning it over completely so that the stub 4 comes to lie at the lowest possible point of the turned over top wall 3.

In accordance with another feature of the invention an attachment piece 6 can be placed on the hollow body. Attachment piece 6 has a lower bounding surface 7 such that it is complementary to the top wall 3 of the hollow body. The upper surface 8 of the attachment piece 6 is formed such that it is complementary to the base of the hollow body, so that when the base is flat a flat upper surface is also necessary. Should the base have a concave disposition, then the upper surface 8 can likewise be given a complementary concave form. Containers as in FIG. 1 in this way become stackable on one another.

The periphery of the attachment piece is preferably of the same form as the peripheral edge 3*a*, which results not only in the container acquiring an aesthetically pleasing appearance but also in the edge 3*a* being protected if the container falls over or is subjected to other types of impact stress.

In this embodiment the attachment piece 6 is formed on the front right-hand side with a through-running opening in the form of a recess 9 into which fits the filling stub 4. Owing to the height of attachment piece 6, which is at least equal to the height of stub 4, the stub 4 with screw cap 5 can be completely safeguarded against outside impacts. This also contributes to an increased safety of the container.

The attachment piece can in addition be formed with an opening 10, in which can be accomodated one or more handles 11. These latter are usually connected directly to the top wall 3 of the hollow body, so that the attachment piece is not loaded by carrying forces.

For easy attachment the opening 10 is closed off at the bottom with a base plate 12 into which are recessed two through-running holes 13. Protruding through each through-running hole 13 is a projection 14 which is attached rigidly to the top wall 3. Projections 14 are formed with holes for accomodating pins 15 which are inserted through two parallel legs 16 of handles 11, these legs 16 being placed on either side of projections 14.

The attachment piece 6 is in this way locked automatically after mounting of the handles 11 on projections 14.

Figure 3:
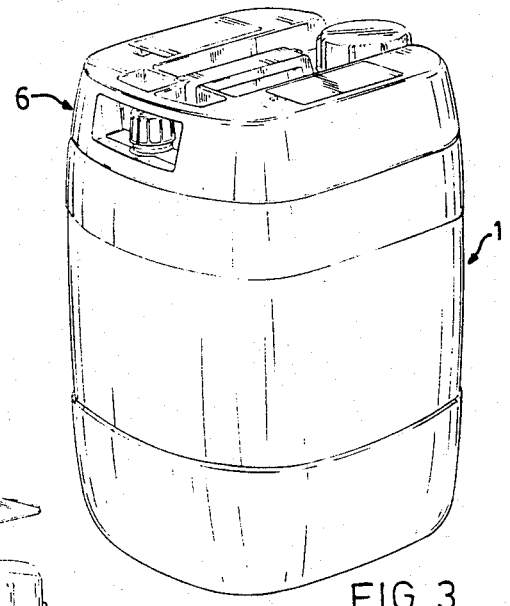
FIGS. 3 and 4 are perspective views of a container according to a second embodiment of the invention and, FIG. 5 is a cross-sectional view according to line V—V in FIG. 4.
Figure 4:
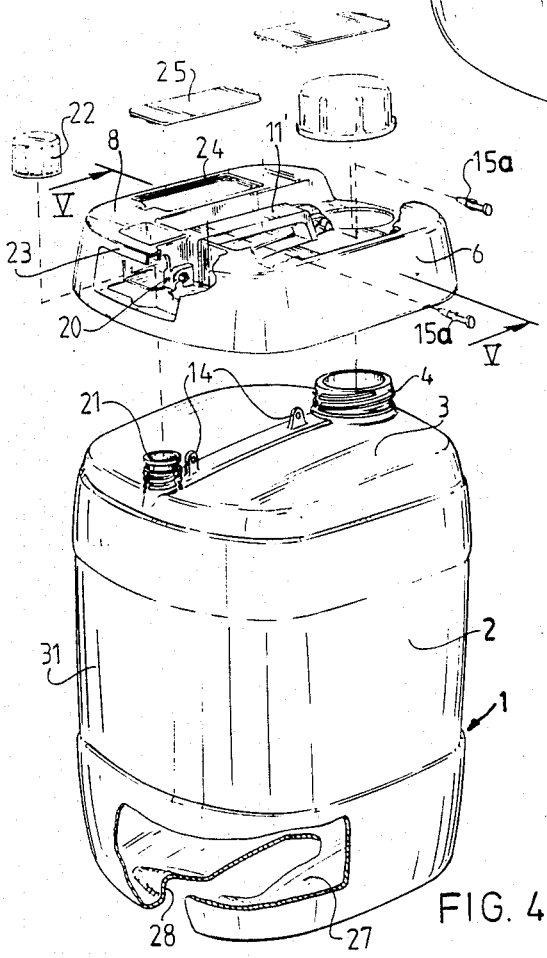

Turning now to the embodiment depicted in FIGS. 3 and 4, wherein the same reference numerals are used for the same parts of the container with respect to the one described hereabove, the main difference is the more rounded form of the side walls 2, so when stacking the containers side by side and on top of each other, a space is left between the neighbouring containers, so forming cooling channels for air circulation. Such cooling channels prevent decomposition of the contents of the containers.

Furthermore the stacking attachment piece 6 is provided with a grip 11' as a single injection moulded piece. At both extremities of the hand grip 11', chamber-like protrusions are provided for taking up the projections 14 on top of the top wall of the hollow body 1. The chamber-like protrusion 20 is provided with a hole corresponding with the hole in the projection 14, such that when mounting the attachment piece 6 upon the hollow body, bolts 15*a* have to be inserted in the holes in order to secure the piece 6 to the hollow body 1.

The container according to FIGS. 3 and 4 is further provided with an aerating stub 21, which like the pouring stub 4 can be closed by a screw cap 22. With respect to the position of the aerating stub 21, the attachment piece 6 is provided with a bridging member 23, connecting the upper surface 8 of the attachment piece and extending just above the aerating stub 21 when the piece 6 is secured to the hollow body 1.

The upper surface 8 of the attachment piece 6 is further provided with a boundary line 24, here shown as a rectangular opening in the upper surface 8. The opening or orifice can be closed by a cover 25 adapted to be snapped-on in the upper surface 8. The space in between the upper surface 8 and the top wall 3 of the hollow body 1 can be used as storing space for a pouring tube 26 or the like, see FIG. 5.

In an alternative embodiment the boundary line 24 of the attachment piece can be formed as a score line during moulding of the piece 6. The score line provides a weakened portion to enable the part of the upper surface 8 within the boundary line 24 to be pushed out. Any suitable connection member can be used then for replacing the pushed out portion in the upper surface 8 to close off the formed opening.

Finally, it is noted that the bottom or base 27 of the hollow body is provided with a recess 28, which is bulged inwardly, so forming a hand grip when pouring the liquid out of the hollow body 1.

Figure 5:
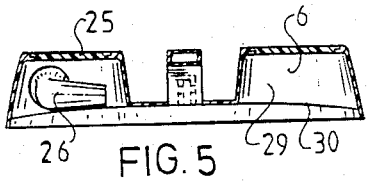

Turning to FIG. 5 it is easy to see that the stacking attachment piece 6 is an scale-like injection moulded piece or blown moulded piece, which is preferably rigidified by suitable rib-like partitions 29, the lower edge 30 of the partitions 29 being supported on the top wall 3 of the hollow body 1, so assuring a stable stacking of the containers on top of each other.

Figure 2:
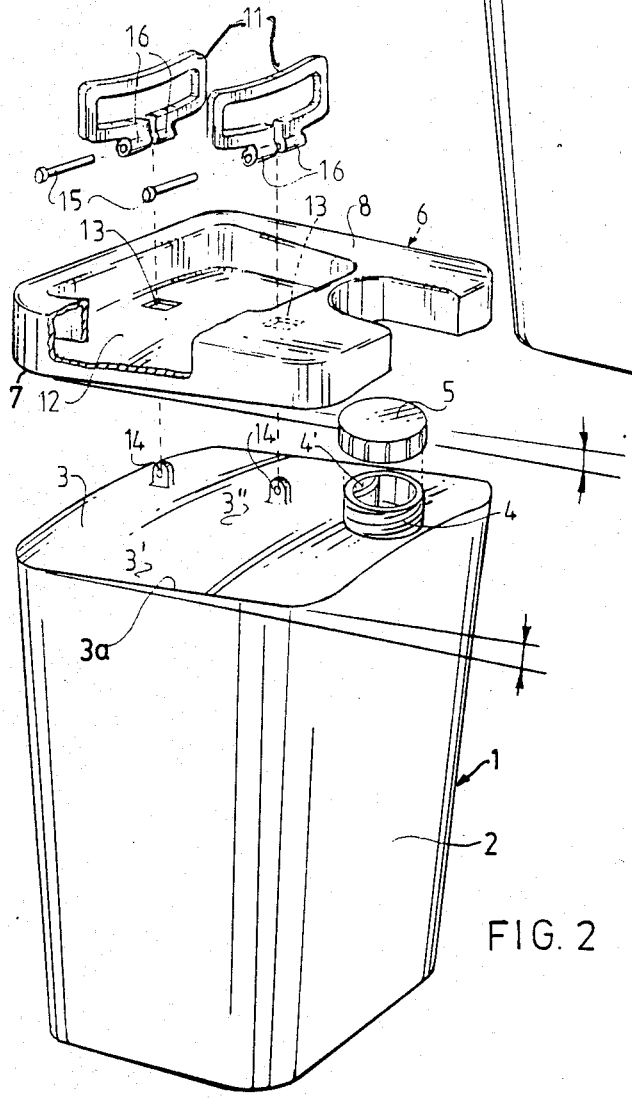
FIG. 2 is a perspective top view of the container as in FIG. 1, whereby the composite parts are in exploded view.

Other embodiments are possible within the scope of the invention. Thus, for example, the attachment piece 6 can be permanently fastened to the hollow body 1. Also, as seen in FIG. 2, the side walls 2 of the hollow body 1 may be outwardly bulged in configuration as they extend from the bottom to the top wall 3.

Within the scope of the invention any convenient form of the upper surface of the attachment piece is possible, for instance provided with lugs cooperating with recesses in the base 27 of the hollow body 1 to ameliorate a stable stacking of the containers. Finally, it is noted that the side walls 2 of the hollow body may be provided with a recess portion 31 (see FIG. 4) for receiving a printed sleeve bearing the necessary information regarding the contents of the container.

I claim:

1. A plastic container for pourable material comprising a hollow body having a bottom surface, upstanding side walls extending upwardly from the bottom surface, a top wall connected to and closing the side walls, and a pouring/filling neck protruding upwardly from the top wall, a stacking attachment piece fitted onto the top of the hollow body and presenting an upper surface lying above the pouring/filling neck which is complementary to the bottom surface, and carrying handle means for detachably connecting the stacking attachment piece to the hollow body.

2. A plastic container as defined in claim 1 wherein the carrying handle means comprises a carrying handle integral with the attachment piece.

3. A plastic container as defined in claim 1 wherein the carrying handle means comprises a carrying handle pivotally connected to the hollow body and overlying the attachment piece.

4. A plastic container as defined in claim 1 wherein the carrying handle means is detachably connected to the top wall of the hollow body.

5. A plastic container as defined in claim 1 wherein the stacking attachment piece is provided with a cut-out exposing the pouring/filling neck.

6. A plastic container as defined in claim 1, wherein said hollow body includes an aerating stub connected to said top wall thereof, said aerating stub including a closing element, and wherein said stacking attachment piece provides an open portion in which said aerating stub with said closing element extends and a bridging member 23 which overlies the closing element of said aerating stub.

7. A plastic container as defined in claim 1, wherein said stacking attachment piece includes a base plate which is contoured to conform to a contour of the top wall of said hollow body.

8. A plastic container as defined in claim 1, wherein said stacking attachment piece provides a storage chamber therein and wherein the upper surface of said stacking attchment piece above said storage chamber includes a score line which defines therewithin a portion which can be removed to provide an opening to said storage chamber.

9. A plastic container as defined in claim 1, wherein said side walls of said hollow body are outwardly bulged in configuration as they extend from said bottom surface to said top wall.

10. A plastic container as defined in claim 1 wherein said stacking attachment piece is injection molded.

11. A plastic container as defined in claim 1 wherein said bottom surface of said hollow body includes a recess that provides a hand grip.

12. A plastic container as defined in claim 1 wherein the top wall of said hollow body has a periphery which is connected to upper ends of said side walls and wherein the top wall is contoured to curve upwardly with respect to said periphery, such that any pourable material in said hollow body will completely leave said hollow body through said pouring/filling neck when said hollow body is inverted.

* * * * *